US005456732A

United States Patent [19]

Baxter

[11] Patent Number: 5,456,732

[45] Date of Patent: Oct. 10, 1995

[54] SELF-KINDLING FUEL PACKAGE

[75] Inventor: Robert O. Baxter, West Monroe, La.

[73] Assignee: Bancroft Bag, Inc., West Monroe, La.

[21] Appl. No.: 404,137

[22] Filed: Mar. 14, 1995

Related U.S. Application Data

[63] Continuation of Ser. No. 89,312, Jul. 12, 1993, abandoned.

[51] Int. Cl.[6] ..... C06C 5/00; C10L 11/00

[52] U.S. Cl. ..... 44/519; 44/533; 44/534; 44/541; 53/410; 53/462; 53/474

[58] Field of Search ..... 44/519, 533, 534, 44/541; 53/410, 462, 474

[56] References Cited

U.S. PATENT DOCUMENTS

| | | | |
|---|---|---|---|
| 252,420 | 1/1882 | Blaisdell | 44/519 |
| 2,358,125 | 4/1943 | Anderson | 53/410 |
| 2,548,379 | 4/1951 | Lammersen | 44/533 |
| 2,666,695 | 1/1954 | Brody | 44/40 |
| 3,056,665 | 10/1962 | Linda | 44/40 |
| 4,104,034 | 8/1978 | Wu et al. | 44/534 |
| 4,179,270 | 12/1979 | Clayton | 44/40 |
| 4,225,318 | 9/1980 | Wrigley | 44/40 |
| 4,261,695 | 4/1981 | Reninger | 431/320 |
| 4,775,391 | 10/1988 | Antosko | 44/520 |
| 4,786,290 | 11/1988 | Wyer | 44/519 |
| 4,832,703 | 5/1989 | Campana | 44/519 |

*Primary Examiner*—Jerry D. Johnson
*Attorney, Agent, or Firm*—Sessions & Fishman

[57] ABSTRACT

A self-kindling fuel package comprising a container with walls and at least one pinched closure with a semi-rigid wick longitudinally folded into the end closure creating an oxygen channel within the end closure, and a method of constructing the self-kindling fuel package.

11 Claims, 7 Drawing Sheets

SELF-KINDLING FUEL PACKAGE

This application is a continuation of application Ser. No. 08/089,312 filed Jul. 12, 1993 now abandoned.

BACKGROUND OF THE INVENTION

This inventions directed toward an improved fuel package. More specifically, this invention relates to an improved fuel package of the self-kindling type as used in outdoor cooking and barbecues.

Fuel packages of the self-kindling type for making and sustaining a fire for outdoor cooking are well known. Self-kindling fuel packages have been developed in an attempt to remove some of the difficulties and inconvenience inherent in the use of common charcoal briquets and charcoal lighter fluid. Charcoal briquets are messy to handle and generally sold in relatively large bags. Even after charcoal briquets have been placed in a grill, igniting the briquets is difficult and time consuming. The most common method is to saturate the briquets with lighter fluid and then light the briquets with a match. One must then wait for all of the fluid to burn away before the briquets begin to smolder. Because this is so slow and uncertain, there is always the temptation to attempt to relight the briquets by spraying lighter fluid and relighting. This is an extremely dangerous practice which could result in serious harm.

In order to provide more convenience and safety, self contained fuel packages have been developed which contain their own means of kindling. Of the several self-kindling fuel packages known, most employ loose charcoal briquets in a combustible container with some sort of igniting means in the container. Unfortunately, while such fuel packages would seem to eliminate the need to handle messy charcoal and lighter fluid, they are complicated and expensive to manufacture. One common type comprises a combustible bag which is filled with a charge of briquets and sealed at each end, after which a combustible wick is sewn on each end of the bag.

SUMMARY OF THE INVENTION

It is an object of the present invention to provide an improved self-kindling fuel package wherein an efficient ignitable wick is incorporated in the fuel package as the container is sealed, not as an extra step, thereby being less expensive and simpler to manufacture. It is another object of this invention to provide a more reliable fuel package by insuring the ignitable wick receives sufficient oxygen to burn effectively. In accordance with the present invention, there is provided an improved self-kindling fuel package having at least one pinched end closure and an ignitable semirigid wick located in the pinched end closure for igniting a charge of fuel.

DETAILED DESCRIPTION OF THE PREFERRED EMBODIMENTS

Figure 1:
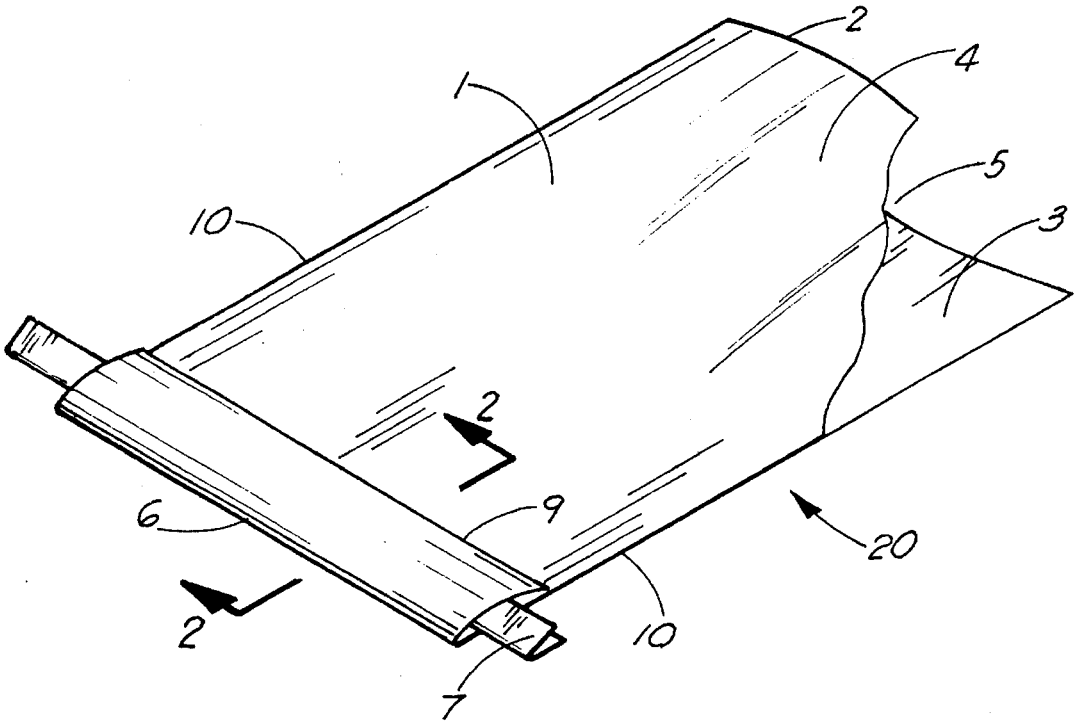
FIG. 1 is a perspective view of an embodiment of the self-kindling fuel package of the present invention, with a portion of the package container wall cut away.

The objects and advantages of the present invention are achieved through the provision of a self-kindling fuel package, as for example the package 20 which is depicted in FIG. 1. As shown in FIG. 1, the package includes a container I having a wall 2 for enclosing fuel therein. Said container wall 2 has an outer face 4 and an inner face 3, said inner face defining an interior space 5 for accommodating fuel. The container wall 2 is of a combustible material and can be either a single layer or comprised of multiple layers.

Figure 2:
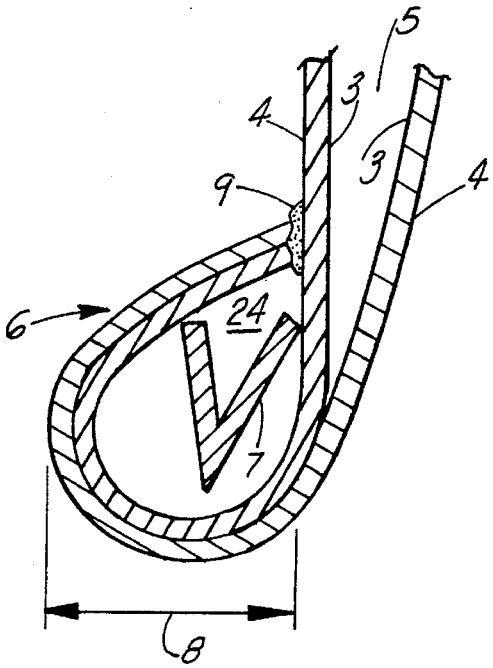
FIG. 2 is a cross-section of the end closure of the package depicted in FIG. 1, taken along line 2—2 of FIG. 1.
Figure 3:
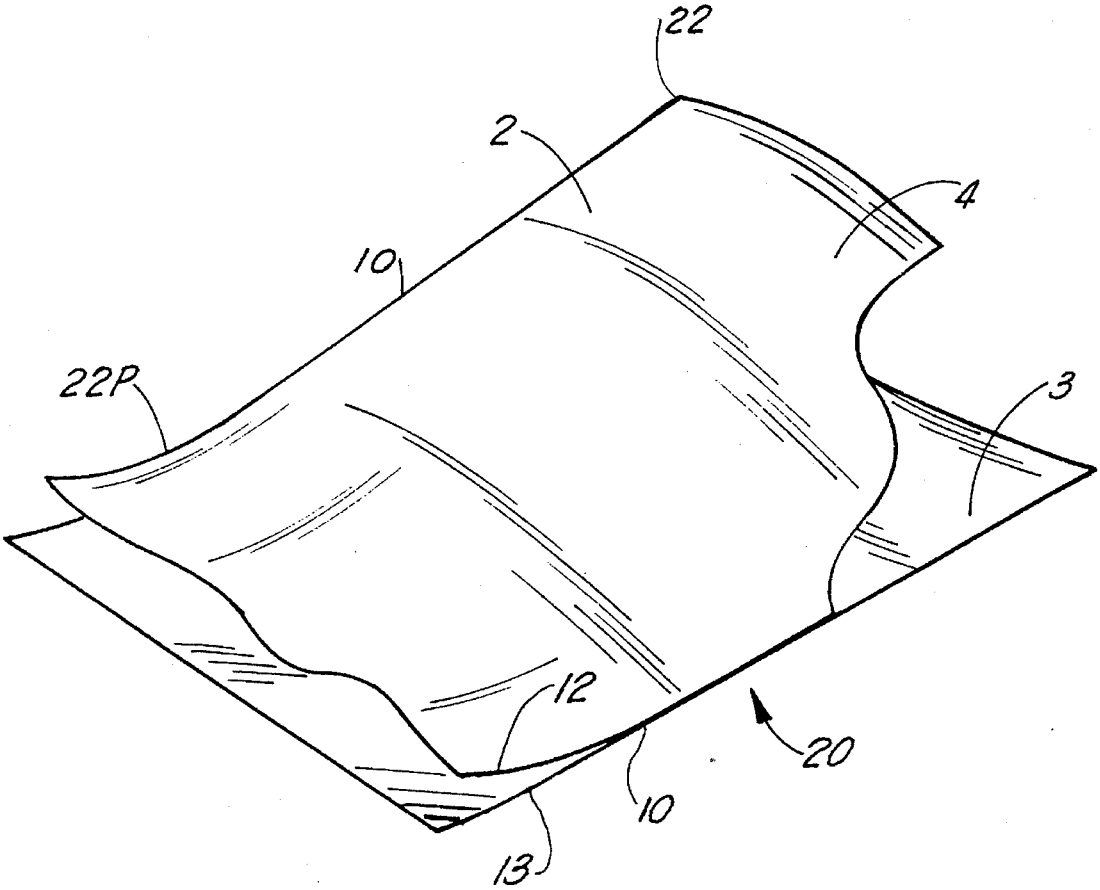
FIG. 3 is a perspective view of the fuel package of FIG. 1 shown with an uncompleted end closure.
Figure 11:
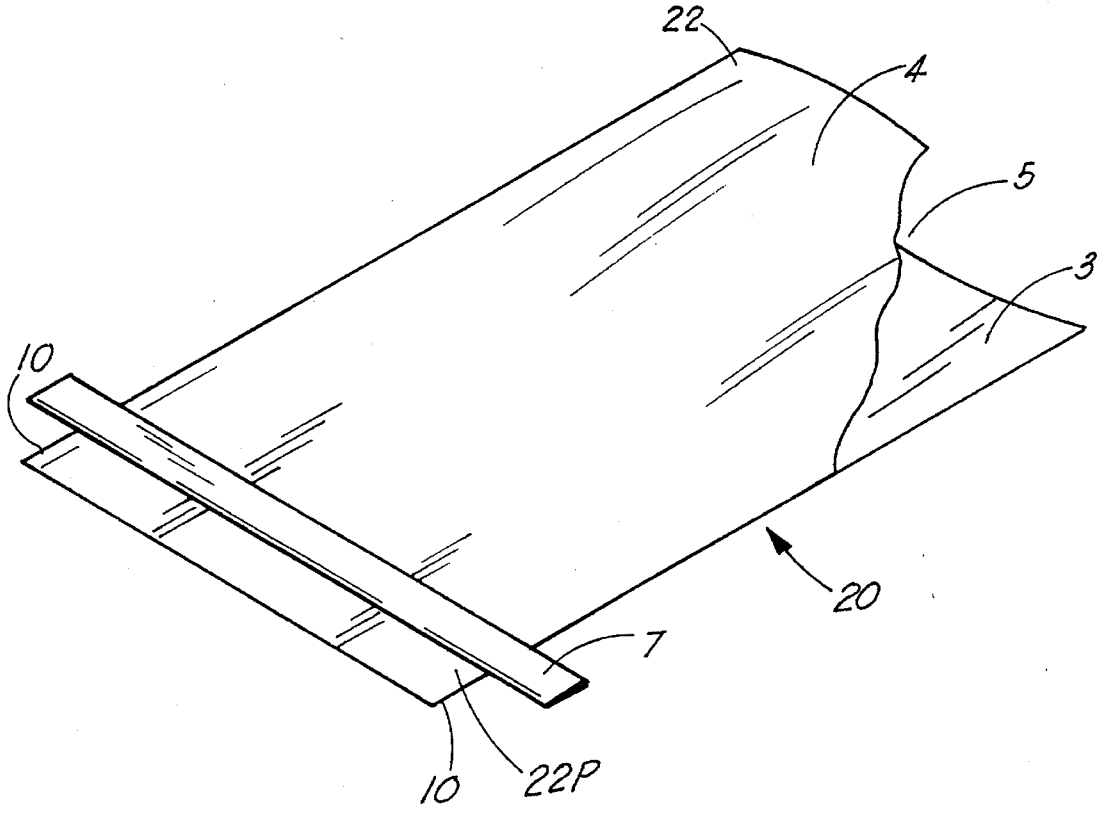
FIG. 11 is a perspective view of the package of FIG. 1 showing a wick located at a pinched end section of the container wall prior to folding said pinched end section.

At each end of the container wall 2 is an end section 22, as depicted in FIGS. 3 and 11. The container 1 has at least one end closure 6, which may be formed by pinching together an end section 22P of the container wall, as best shown in FIG. 11, and folding it at least once, as best shown in FIGS. 1 and 2.

In the preferred embodiment of the invention, prior to folding the pinched end section 22P to create end closure 6, semirigid wick 7 is located at said pinched end section 22P, as shown in FIG. 11. The pinched end section 22P of the container wall 2 is then folded at the location of wick 7 such that said wick is longitudinally folded and encased within the fold 8 of the pinched end section 22P of container wall 2, as shown in FIGS. 1 and 2. Alternatively, wick 7 may be longitudinally folded and inserted into fold 8 after the pinched end section 22 has been folded.

Wick 7 is of combustible material, preferably presaturated with a volatile solvent. The wick material is semirigid so that the wick will not stay folded completely flat, but will have a tendency to spring open, thereby creating an oxygen channel 24 within end closure 6, as best shown in FIG. 2. Oxygen channel 24 effectively promotes combustion of wick 7, which in turn effectively promotes combustion of the package and the fuel contained therein.

A suitable means 9, such as an adhesive, is used for maintaining fold 8 of the pinched end section of the container wall, as best depicted in FIG. 2.

FIG. 11 shows an embodiment of the fuel package 20 with an uncompleted end closure, in which the end section 22P of the container wall is pinched together so as to form creased edges 10 on opposite sides of the container. Edges 10 may be partially slit, as depicted in FIG. 3, so as to create portions of the container wall, 12 and 13, which can be folded independently of each other.

Figure 4:
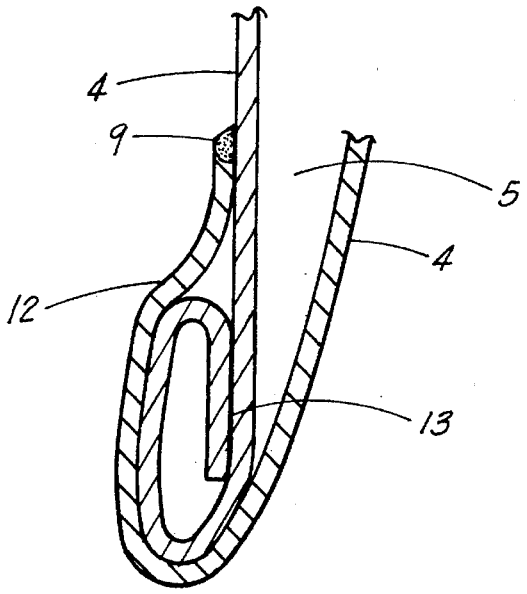
FIG. 4 is a cross-section of a double-folded end closure of a fuel package shown without a wick.
Figure 5:
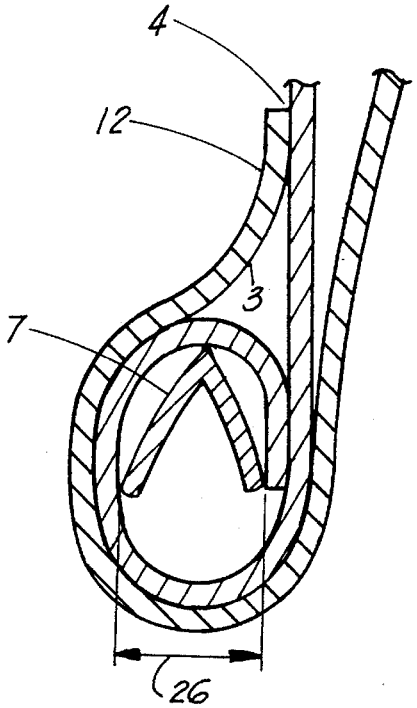
FIG. 5 is a cross-section of a double-folded end closure of an embodiment of the present invention in which the wick is encased entirely within the first fold.

In an alternative embodiment of the invention, best shown in FIGS. 4 and 5, the pinched end section of the container wall is double-folded except for independently folding portion 12 of the container wall which is single folded. At least part of the inner face 3 of the single-folded portion 12 of the container wall is affixed to the outer face 4 of the container wall, thereby providing a means for maintaining the fold of the pinched end section of the container wall.

Figure 6:
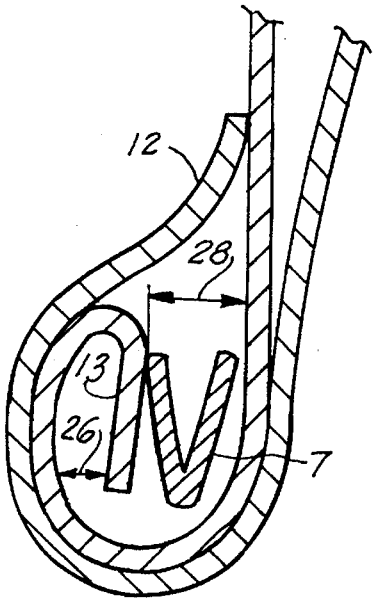
FIG. 6 is a cross-section of a double-folded end closure of an embodiment of the present invention in which the wick is encased entirely within the second fold.
Figure 7:
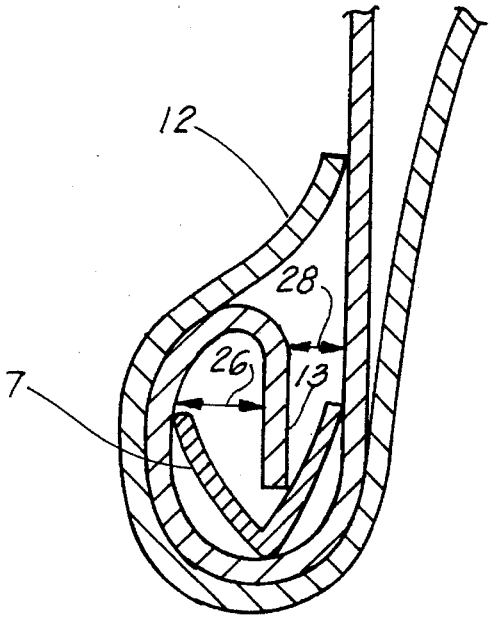
FIG. 7 is a cross-section of a double-folded end closure of an embodiment of the present invention in which a portion of the wick is encased within the first fold and a portion of the wick is encased within the second fold.

In the alternative embodiment of the invention depicted in FIG. 5, wick 7 is encased entirely within the first fold 26 of the pinched end section of the container wall. In the alternative embodiment of the invention depicted in FIG. 6, wick 7 is encased entirely within the second fold 28 of the pinched end section of the container wall. In the alternative embodiment of the invention depicted in FIG. 7, a portion of wick 7 is encased within the first fold 26 of the pinched end section of the container wall, and a portion of wick 7 is encased within the second fold 28 of the pinched end section of the container wall.

Figure 9:
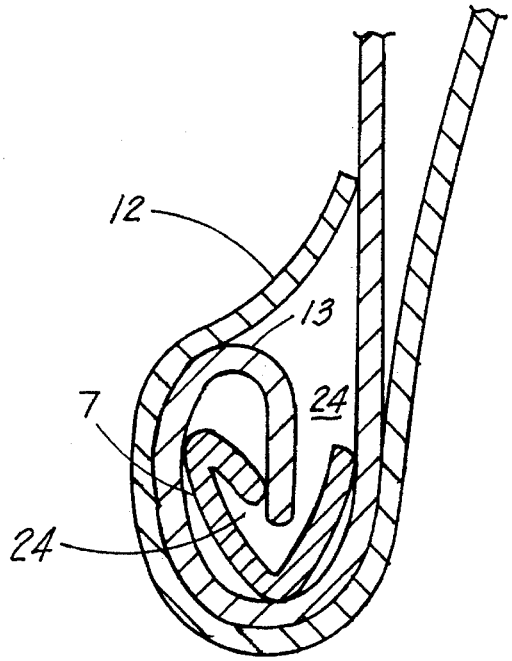
FIG. 9 is a cross-section of a double-folded end enclosure of an alternative embodiment of the present invention in which the wick is double-folded.

In still another alternative embodiment of the invention, as depicted in FIG. 9, wick 7 is double-folded within the pinched end section of the container wall. Such double-folding of semirigid wick 7, with its tendency to spring open, creates multiple oxygen channels 24, thereby further enhancing the combustion of the wick, package and fuel contained therein.

Figure 10:
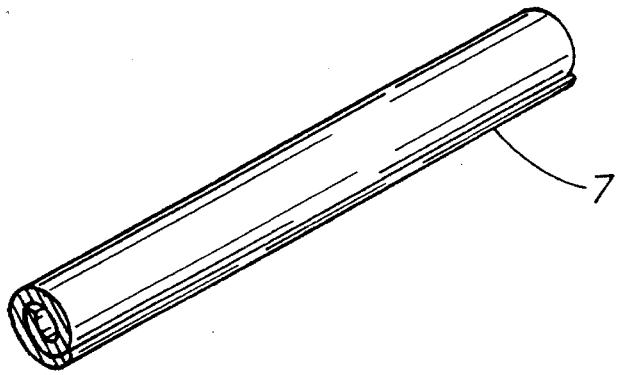
FIG. 10 is a perspective view of an alternative embodiment of a wick of the present invention.

In yet another alternative embodiment of the invention, wick 7 is folded in a circular configuration, as shown in FIG. 10.

Figure 8:
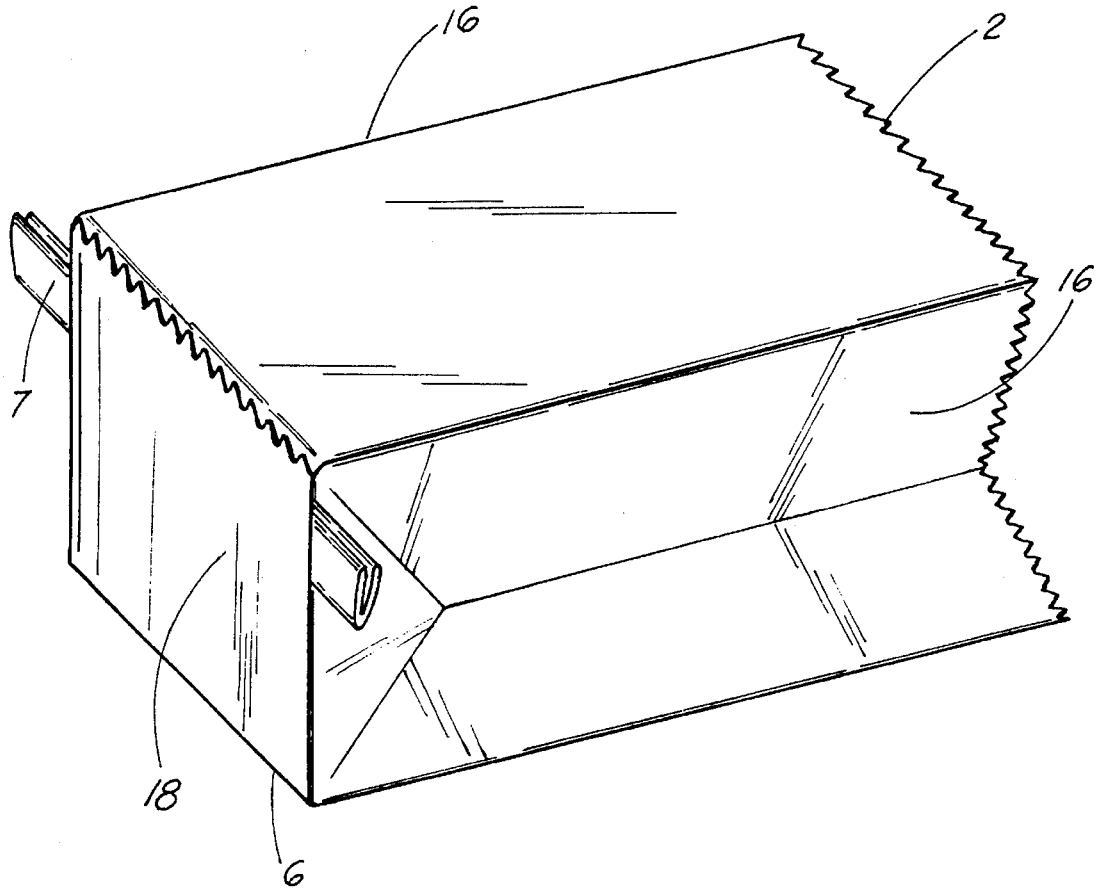
FIG. 8 is a perspective view of an alternative embodiment of the self-kindling fuel package of the present invention.

FIG. 8 shows an alternative embodiment of the invention in which the container wall 2 includes gusset panels 16, which allow for increased interior space within the package. The package depicted in FIG. 8 also includes a bottom member 18, which provides for an end closure 6 having a flat configuration rather than the tapered configuration of the end closure shown in FIG. 1.

In the preferred embodiment of the invention, in order to facilitate lighting of the wick, said wick extends laterally beyond the sides of the container, as shown in FIGS. 1 and 8.

While specific embodiments of the invention have been shown and described in detail to illustrate the application of the principles of the invention, it will be understood that the invention may be embodied otherwise without departing from such principles.

What is claimed is:

1. A self-kindling fuel package comprising:

a container having a wall for enclosing charcoal impregnated with solvents therein, said container wall having an outer face and an inner face, said inner face defining an interior space for accommodating said charcoal impregnated with solvents;

said container also having at least one end closure, said end closure comprising an end section of the container wall which is pinched together; a semi-rigid wick located at the pinched end section of the container wall, wherein the pinched end section of the container wall is folded at the location of said wick such that the wick is longitudinally folded and encased within the fold of the pinched end section of the container wall and springs open to thereby create an oxygen channel within the end closure;

and means for maintaining the fold of the pinched end section of the container wall.

2. The device of claim 1 wherein said end section of the container wall is pinched together so as to form edges on opposite sides of said container, and wherein said edges are slit so as to create portions of said container wall which can be folded independently of each other.

3. The device of claim 2 wherein the pinched end section of the container wall is double-folded except for an independently folding portion of the container wall which is single folded, and wherein at least part of the inner face of said single folded portion of the wall is affixed to the outer face of the container wall, thereby providing means for maintaining the fold of the pinched end section of the container wall.

4. The device of claim 3 wherein the wick is encased entirely within the first fold of the pinched end section of the container wall.

5. The device of claim 3 wherein the wick is encased entirely within the second fold of the pinched end section of the container wall.

6. The device of claim 3 wherein a portion of the wick is encased within the first fold of the pinched end section of the container wall and a portion of the wick is encased within the second fold of the pinched end section of the container wall.

7. The device of claim 3 wherein the wick is double-folded within the pinched end section of the container wall.

8. The device of claim 3 wherein the wick extends laterally beyond the edges of the container.

9. A method of constructing a self-kindling fuel package, comprising the steps of:

providing a container having a wall for enclosing fuel therein, said container wall having an end section;

pinching together said end section of said container wall so as to form an end closure and so as to form edges on opposite sides of said container;

positioning a wick at the pinched end section of the container wall;

folding the pinched end section of the container wall at the location of the wick such that the wick is longitudinally folded and encased within the fold of the pinched end section of the container wall, thereby creating an oxygen channel within the end closure; and providing a means for maintaining the fold of the pinched end section of the container wall.

10. The method of claim 9 including the additional step of slitting the edges so as to create portions of said container wall which can be folded independently of each other, said slitting step being performed prior to the step of folding the pinched end section.

11. The method of claim 10 wherein the step of folding the pinched end section of the container wall includes double-folding said pinched end section except for an independently folding portion of the container wall which is single-folded, and affixing at least a part of the inner face of said single-folded portion of the container wall to the outer face of the container wall.

* * * * *